US005397436A

United States Patent [19]

Robeson et al.

[11] Patent Number: 5,397,436

[45] Date of Patent: Mar. 14, 1995

[54] PAPER WET-STRENGTH IMPROVEMENT WITH CELLULOSE REACTIVE SIZE AND AMINE FUNCTIONAL POLY(VINYL ALCOHOL)

[75] Inventors: Lloyd M. Robeson, Macungie; George Davidowich; Robert K. Pinschmidt, Jr., both of Allentown, all of Pa.

[73] Assignee: Air Products and Chemicals, Inc., Allentown, Pa.

[21] Appl. No.: 207,460

[22] Filed: Mar. 7, 1994

Related U.S. Application Data

[63] Continuation-in-part of Ser. No. 914,661, Jul. 15, 1992, abandoned.

[51] Int. Cl.[6] ..... D21H 21/20

[52] U.S. Cl. ..... 162/158; 162/168.2; 162/179

[58] Field of Search ..... 162/158, 179, 168.2; 106/243, 287.24

[56] References Cited

U.S. PATENT DOCUMENTS

| | | | |
|---|---|---|---|
| 2,961,366 | 11/1960 | Weisgerber | 162/158 |
| 3,535,288 | 10/1970 | Lipowski et al. | 260/78 |
| 3,597,314 | 8/1971 | Lambe et al. | 162/168 |
| 3,715,336 | 2/1973 | Nowak et al. | 260/77.5 |
| 4,311,805 | 1/1982 | Moritani et al. | 525/60 |
| 4,421,602 | 12/1983 | Brunnmueller et al. | 162/168.2 |
| 4,772,359 | 9/1988 | Linhart et al. | 162/163 |
| 4,774,285 | 9/1988 | Pfohl et al. | 525/60 |
| 4,784,727 | 11/1988 | Schroer et al. | 162/158 |
| 4,808,683 | 2/1989 | Itagaki et al. | 526/307.2 |

FOREIGN PATENT DOCUMENTS

| | | |
|---|---|---|
| 1155597 | 6/1979 | Canada . |
| 0251182 | 6/1987 | European Pat. Off. . |
| 0331047 | 2/1989 | European Pat. Off. . |
| 0337310 | 4/1989 | European Pat. Off. . |

OTHER PUBLICATIONS

*Encyclopedia of Polymer Science and Engineering;* vol. 10; pp. 761–786.

Zhou; *Paper Technology;* pp. 19–22; Jul. 1991.

Marton; *Tappi J.;* pp. 139–143; Nov. 1990.

*Primary Examiner*—Peter Chin

*Attorney, Agent, or Firm*—Mark L. Rodgers

[57] ABSTRACT

The wet strength of cellulosic paper is improved by adding the combination of an amine-functional poly(vinyl alcohol) and a cellulose reactive size which is a 4 or 5 membered cyclic ester or anhydride having alkyl or alkenyl substituents of 4 or more carbon atoms. The amine-functional polymer is preferably a hydrolyzed copolymer of vinyl acetate and N-vinylformamide in which about 1–25 mole % of the monomer units are incorporated N-vinylformamide, and the cellulose reactive size is preferably an alkyl ketene dimer or an alkenyl succinic anhydride. A paper product is provided having improved wet-strength and containing normally 0.05 to 4.0 wt % based on the dry pulp of the additive amine-functional polymer and cellulose reactive size. The particular compounds which represent the polymer and the size cooperate to provide improvements in wet-tensile strength for paper which could not have been foreseen from the effects of either material acting alone.

11 Claims, 1 Drawing Sheet

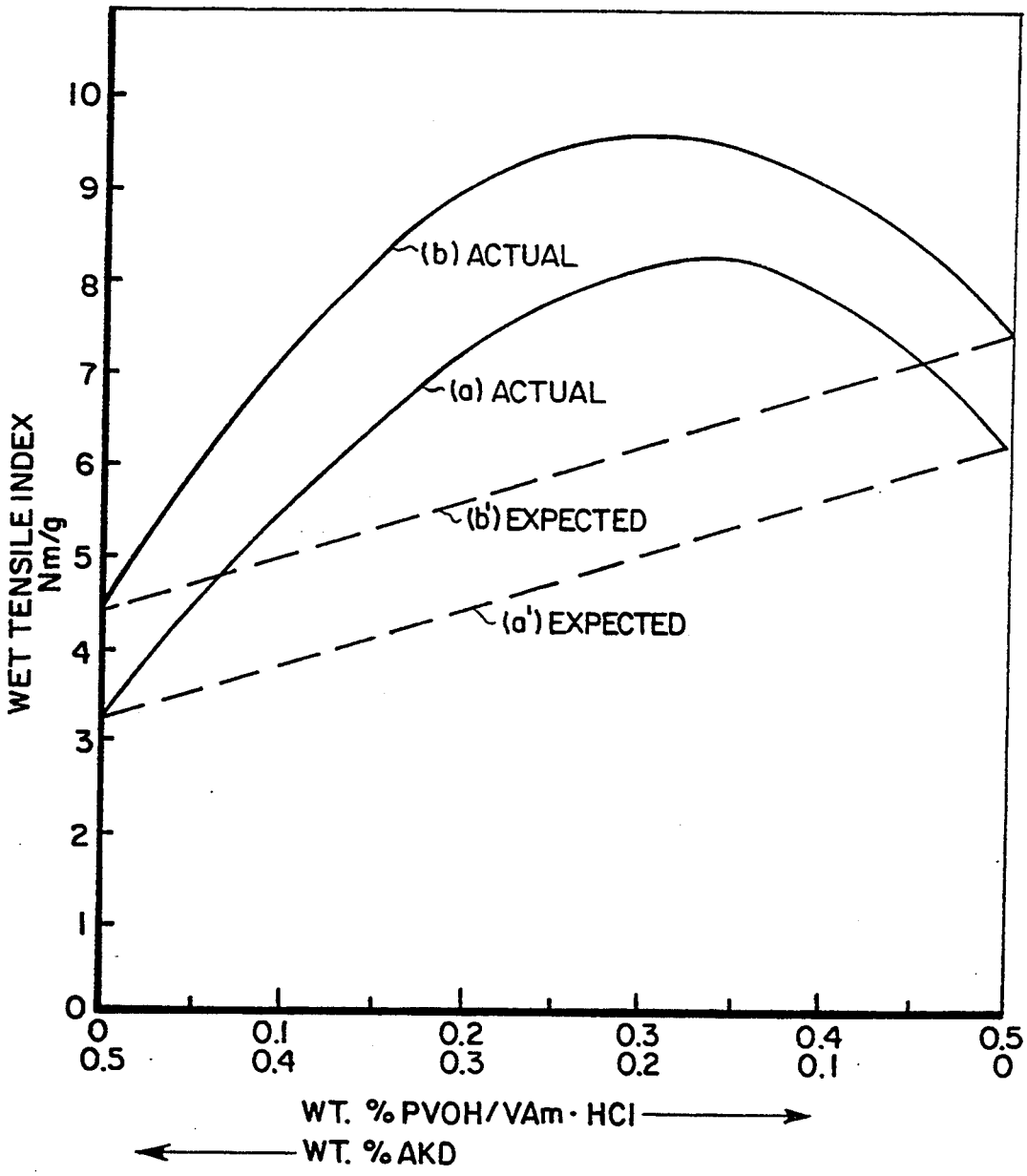
WET TENSILE INDEX
Nm/g
10
9
8
7
6
5
4
3
2
1
0
(b) ACTUAL
(a) ACTUAL
(b') EXPECTED
(a') EXPECTED
0 0.1 0.2 0.3 0.4 0.5
0.5 0.4 0.3 0.2 0.1 0
WT. % PVOH/VAm · HCl
WT. % AKD

PAPER WET-STRENGTH IMPROVEMENT WITH CELLULOSE REACTIVE SIZE AND AMINE FUNCTIONAL POLY(VINYL ALCOHOL)

CROSS REFERENCE TO PARENT APPLICATION

This is a continuation-in-part of application Ser. No. 07/914,661, filed 15 Jul. 1992, now abandoned, the subject matter of which is hereby incorporated by inference.

FIELD OF THE INVENTION

This invention relates to a method of improving the wet-strength properties of cellulosic paper. In another aspect it relates to paper containing the combination of a cellulose reactive size and an amine functional poly(-vinyl alcohol).

BACKGROUND OF THE INVENTION

In order to improve paper properties and reduce manufacturing costs in papermaking, various additives are applied to the pulp slurry prior to sheet formation or after an initial drying of the paper. Those additives applied to the pulp in an aqueous slurry are known as wet-end additives and include retention aids to retain fines and fillers, for example, alum, polyethylene imine, cationic starches and the like; drainage aids, such as polyethylene imine; defoamers; and pitch or stickies additives, such as microfibers and adsorbent fillers. Other wet-end additives include polymers such as, cationic polyarylamides and poly(amide amine/epichlorohydrin) which are added to improve wet strength as well as dry strength of the paper. Starch, guar gums, and polyacrylamides are also added to yield dry strength improvements. Sizing agents are occasionally added to impart hydrophobic character to the hydrophilic cellulosic fibers. These agents are used in the manufacture of paper for liquid containers, for example, milk or juice, paper cups and surfaces printed by aqueous inks where it is desired to prevent the ink from spreading. Such sizing agents include rosin sizes derived from pine trees, wax emulsions and, more recently, cellulose-reactive sizes.

The application of additives to paper after an initial drying of the sheet by spraying, capillary sorption, immersion, roll-coating, and the like, is often referred to as a dry-end addition. Poly(vinyl alcohol), acrylic or vinyl acetate emulsions, starches, sizing agents, polyurethanes, and SBR latex are commonly added at the dry end.

Improvements are continually sought in wet-strength additives for paper. Improved speed of wet-strength development is desired and many wet strength additives require both time and temperature to develop their wet strength properties. Initial wet strength is desired to improve the wet web strength during paper formation. A review of the utility of paper additives is given by G. G. Spence, *Encyclopedia of Polymer Science and Technology,* Second Edition, Wiley-Interscience, Vol. 10, pgs. 761–786, New York (1987).

The use of functional polymers of various types has been known for many years as a means to improve papermaking processes and paper properties. Several of these resins for improving wet strength of the paper have involved products derived from epihalohydrin. U.S. Pat. No. 3,535,288 Lipowski, et al. (1970) discloses an improved cationic polyamide-epichlorohydrin thermosetting resin as useful in the manufacture of wet-strength paper. U.S. Pat. No. 3,715,336 Nowak, et al. (1973) describes vinyl alcohol/vinylamine copolymers as useful flocculants in clarification of aqueous suspensions and, when combined with epichlorohydrin, as useful wet-strength resins for paper. The copolymers are prepared by hydrolysis of vinylcarbamate/vinyl acetate copolymers made by copolymerization of vinylacetate and vinyl isocyanate followed by the conversion of the isocyanate functionality to carbamate functionality with an alkanol. Additionally, Canadian Patent No. 1,155,597 (1983) discloses wet-strength resins used in papermaking, including polymers of diallylamine reacted with epihalohydrin and a vinyl polymer reacted with epihalohydrin wherein the vinyl polymer is formed from a monomer prepared by reacting an aromatic vinyl alkyl halide with an amine, such as dimethylamine.

Functional polymers derived from amides have also been used to improve paper processes. U.S. Pat. No. 3,597,.314 Lanbe, et al. (1971) discloses that drainage of cellulose fiber suspensions can be enhanced by the addition of a fully or partially hydrolyzed polymer of N-vinyl-N-methyl carboxylic acid amide. U.S. Pat. No. 4,311,805 Moritani, et al. (1982) discloses paper-strength additives made by copolymerizing a vinyl ester, such as vinyl acetate, and an acrylamide derivative, followed by hydrolysis of the ester groups to hydroxy groups. The presence of the remaining cationic groups enables the polymer to be adsorbed on pulp fibers. Utilities for the polymers as sizing agents, drainage aids, size retention aids and as binders for pigments are disclosed but not demonstrated. U.S. Pat. No. 4,421,602 Brunnmueller, et al. (1983) describes partially hydrolyzed homopolymers of N-vinylformamide as useful as retention agents, drainage aids and flocculants in papermaking. European Patent Application 0,331,047 (1989) notes the utility of high molecular weight poly(vinylamine) as a wet-end additive in papermaking for improved dry strength and as a filler retention aid.

More recently, vinylamide copolymers have been disclosed as useful in papermaking to improve the properties of the product. U.S. Pat. No. 4,774,285 Pfohl, et al. (1988) describes amine functional polymers formed by copolymerizing vinyl acetate or vinyl propionate with N-vinylformamide (NVF) followed by 30–100% hydrolysis to eliminate formyl groups and the acetyl or propionyl groups. The copolymer contains 10–95 mole % NVF and 5–90 mole % vinyl acetate or vinyl propionate. The hydrolyzed copolymers are useful in papermaking to increase dry strength and wet strength when added in an amount of 0.1 to 5 wt % based on dry fiber. The polymer can be added to the pulp or applied to the formed sheet. The two polymers used to show dry and wet strength improvements are said to contain 40% and 60% N-vinylformamide before hydrolysis. Lower levels of amine functionality in poly(vinyl alcohol) are not demonstrated to be effective.

U.S. Pat. No. 4,808,683 Itagaki, et al. (1989) describes a vinylamine copolymer such as a copolymer of N-vinylformamide and N-substituted-acrylamide, which is said to be useful as a paper strengthening agent and European Patent Application 0,251,182 (1988) describes a vinylamine copolymer formed by hydrolysis of a copolymer of N-vinylformamide and acrylonitrile or methacrylonitrile. The product is said to be useful in papermaking as a drainage aid, retention aid and strength increasing agent. Examples presented to demonstrate the paper strengthening effect of the polymer used a pulp slurry containing cationic starch, alkyl ketene dimer as a sizing agent and a filler retention improving agent, but there is no indication of any cooperative effect between the polymer and the sizing agent.

On the other hand, certain combinations of additives have been found to be useful as paper additives. U.S. Pat. No. 4,772,359, Linhart, et al. (1988) discloses utility of homopolymers or copolymers of N-vinylamides, such as N-vinylformamide (NVF), in combination with phenol resin as a drainage aid in pulp slurries for production of paper. In this service unhydrolyzed poly NVF is said to function cooperatively with the phenol resin, while a partially hydrolyzed poly NVF does not (see Example 6). European Patent Application No. 0,337,310 (1989) describes improving moist compressive strength of paper products using the combination of hydrolyzed poly(vinylacetate-vinylamide) and an anionic polymer such as carboxymethyl cellulose or anionic starch. The hydrolyzed polymer can contain 1–50 mole % vinylamine units and examples are given of polymers having amine functionality of 3–304.

The contribution of Spence to the *Encyclopedia of Polymer Science and Engineering,* noted above, provides a comprehensive survey of paper additives describing the functions and benefits of various additives and resins used in the manufacture of paper. Wet-end additives are discussed at length. Resins containing amine groups that provide cationic functionality and have low molecular weights ($10^3$ to $10^5$) e.g., polyethylene imine, are used to aid retention of fines in the paper. Acrylamide-based water soluble polymers are used as additives to enhance dry strength of paper while a variety of resins, such a melamine-formaldehyde resins, improve wet strength. Polyethylene imine, however, is said not to be commercially significant as a wet-strength resin. Sizing agents are used to reduce penetration of liquids, especially water, into paper which, being cellulosic, is very hydrophilic. Sizing agents disclosed are rosin-based agents, synthetic cellulose-reactive materials such as alkyl ketene dimer (AKD), alkenyl succinic anhydrides (ASA) and anhydrides of long-chain fatty acids, such as stearic anhydride, wax emulsions and fluorochemical sizes. Cationic retention aids, such as alum, cationic starch or aminopolyamide-epichlorohydrin wet-strength resin, are used to retain the size particles in the sheet.

Martono TAPPI J., pages 139–43 (November 1990) discusses alkyl ketene dimer reactions and points out that hydrolysis is a competing reaction to the esterification reaction between AKD and cellulose, reducing the effectiveness of the size. The AKD size emulsions were stabilized with cationic starch or polyamine amide-epichlorohydrin resin, the latter exhibiting much higher hydrolysis rates. Both AKD and ASA form covalent ester bonds with cellulose-OH groups, but react also, depending upon conditions, with other OH groups in the surrounding medium, foremost through hydrolysis with water.

Zhou, *Paper Technology,* pages 19–22 (July 1991) discusses AKD sizing studies which suggest that AKD sizing increases over a period of time after application, particularly at elevated temperatures.

U.S. Pat. No. 5,114,538 Malatesta (1992) discloses a process for sizing paper and similar products using cyclic acid anhydrides as such or in solution with non-aqueous protic and/or protic solvents. U.S. Pat. No. 2,916,366 Weisgerber (1960) discloses a method of sizing paper by adding an aqueous emulsion of ketene dimer to a dilute aqueous pulp suspension along with from about 0.0014 to about 0.2% poly(vinylamine). U.S. Pat. No. 4,784,727 Schröer, et al. (1988) discloses sizing agents containing from 1 to 60 parts, by weight, of a fixing and sizing accelerating agent and from 0 to 80 parts, by weight, of conventional auxiliaries per 10 parts by weight of hydropholic, cellulose-reactive sizing materials.

SUMMARY OF THE INVENTION

We have discovered an unexpected synergistic cooperation between amine-functional poly(vinyl alcohol) polymers and cellulose reactive sizes in the production of cellulosic paper having improved wet-strength properties. The cellulose-reactive size is a compound which is a 4 or 5 membered cyclic ester or anhydride having alkyl or alkenyl substituents, each of which contains at least 8 carbon atoms. The polymers are preferably made by copolymerization of vinyl acetate and N-vinylformamide followed by hydrolysis to form a copolymer having a relatively low amine functionality on the order of 1–25 mole % based upon the incorporated monomer. The preferred sizing agents are alkyl ketene dimers or alkyl succinic anhydrlides.

According to our invention a cellulosic paper product having improved wet-strength is provided containing products formed by the addition to the paper during manufacture of the combination of an amine-functional poly(vinyl alcohol) resin and a cellulose reactive sizing agent, which sizing agent comprises an alkyl ketene dimer or alkenyl succinic anhydride which have pendant substituents which contain a combined total of at least 8 carbon atoms.

IN THE DRAWINGS

The sole FIGURE is a graph comparing wet tensile properties of paper products of the invention containing various combination levels of alkyl ketene dimer (AKD) and polyvinyl alcohol/vinylamine copolymer (PVOH/VAm·HCl) with expected additive results based upon values obtained using the amine functional poly(vinyl alcohol) alone and the alkyl ketene dimer a 1 one.

DETAILED DESCRIPTION OF THE INVENTION

It has been found that amine-functional poly(vinyl alcohol), in particular poly(vinyl alcohol/vinylamine) copolymers, in combination with a cellulose-reactive size such as an alkyl ketene dimer or alkenyl succinic anhydride offer synergistic wet strength properties when incorporated into paper. The wet strength of the mixture (at constant solids) is higher than expected from the added effects of the copolymer and size when used alone. The intermediate mixtures offer higher wet strength than either of the constituents, even at the same total additive level. This improved wet strength obtained by combining a wet-strength polymer with a sizing agent was unexpected.

Poly(vinyl alcohol) is not effective as a wet strength additive or as an additive in the wet-end of a paper process because it is not substantive to paper and is removed in the presence of water. Surprisingly, low levels of amine functionality in poly(vinyl alcohol), preferably 1 to 25 mole percent based upon the incorporated monomers, show substantive characteristics with retention in the presence of water, leading to improved physical properties under both wet-end and dry-end addition to paper. At higher levels of amine functionality in poly(vinyl alcohol), the economics are generally less favorable and in some cases random copolymers are difficult to synthesize using procedures similar to those employed for producing poly(vinyl acetate). In fact, incorporation of more than about 10 mole % N-vinylformamide in poly(vinyl acetate) is difficult, as composition variation leads to the formation of non-homogeneous products. This can be alleviated by proper delayed feed of the more reactive monomer (NVF).

The preferred routes to amine functional poly(vinyl alcohol) are to synthesize vinyl acetate/N-vinylamides (e.g. N-vinylformamide, N-vinyl-acetamide) copolymers followed by hydrolysis of both the vinyl acetate (to vinyl alcohol) and the vinylamide (to vinylamine). Based on reactivity ratios and economics, incorporation of 5 to 20 mole % of the N-vinylamide is desired. Another preferred route is to react poly(vinyl alcohol) with an aminoaldehyde or aminoacetal. The adehyde (or acetal) reacts with the hydroxyls of PVOH yielding pendant amine groups. Up to 25 mole % of the aldehyde can be incorporated using this route.

Poly(vinyl alcohol) is prepared from the hydrolysis of poly(vinyl acetate). The preparation of poly(vinyl acetate) and the hydrolysis to poly(vinyl alcohol) are well known to those skilled in the art and are discussed in detail in the books "Poly(vinyl alcohol): Properties and Applications," ed. by C. A. Finch, John Wiley & Sons, New York, 1973 and "Poly(vinyl alcohol) Fibers," ed. by I. Sakurada, Marcel Dekker, Inc., New York, 1985. A recent review of poly(vinyl alcohol) was given by F. L. Marten in the *Encyclopedia of Polymer Science and Engineering,* 2nd ed., Vol. 17, p. 167, John Wiley & Sons, New York, 1989.

Poly(vinyl acetate) can be prepared by methods well known in the art including emulsion, suspension, solution or bulk polymerization techniques. Rodriguez in "Principles of Polymer Systems," p. 98–101,403, 405 (McGraw-Hill, NY, 1970) describes bulk and solution polymerization procedures and the specifics of emulsion polymerization. Amine functional poly(vinyl alcohol) can be prepared by copolymerization of N-vinylamides (e.g. N-vinylformamide or N-vinylacetamide), N-allylamides {e.g. N-alkyl formamide), or allyl amine (including acid salts) with vinyl acetate using methods employed for poly(vinyl acetate) polymerizations. Above 10% (mole) incorporation of the N-vinylamides leads to product variations unless delayed feed of the N-vinylamides is employed. With allyl amine, about 10 mole % leads to lower molecular weight than desired, thus the desired vinyl alcohol polymers would contain up to 10 mole % allyl amine.

When preparing poly(vinyl acetate) by suspension polymerization, the monomer is typically dispersed in water containing a suspending agent such as poly(vinyl alcohol) and then an initiator such as peroxide is added. The unreacted monomer is devolatilized after polymerization is completed and the polymer is filtered and dried. This procedure for preparation of poly(vinyl acetate) can also be employed for the vinyl acetate copolymers (as precursors for amine functional poly(vinyl alcohol)) of this invention.

Poly(vinyl acetate) can also be prepared via solution polymerization wherein the vinyl acetate is dissolved in a solvent in the presence of an initiator for polymerization. Following completion of the polymerization, the polymer is recovered by coagulation and the solvent is removed by devolatilization. The vinyl acetate copolymers (as precursors for amine functional poly(vinyl alcohol)) can be prepared via this procedure.

Bulk polymerization is not normally practiced in the commercial manufacture of poly(vinyl acetate) or vinyl acetate copolymers, but can be used if proper provisions are made for removing heat of polymerization.

The hydrolysis of the vinyl acetate/N-vinylamide copolymers of this invention can be accomplished using methods typically employed for poly(vinyl alcohol) as noted in the reference supra. Either acid or base hydrolysis can be conducted to yield the amine functional poly(vinyl alcohol) desired. In the case of acid hydrolysis, the amine group is protonated to yield a positive charge neutralized with an anionic group (e.g. $Cl^-$, $Br^-$, $HSO_4^-$, $H_2PO_4^-$, and the like). Both the amine ($-NH_2$) or protonated versions ($NH_3^+X^-$) are suitable in this invention.

The cellulose reactive sizes of greatest interest for this invention are alkyl ketene dimer (AKD) and alkenyl succinic anhydride (ASA). The alkyl ketene dimer can be represented by the structure:

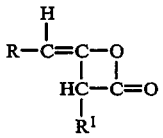

where R and $R^1$ are independently straight or branched chain hydrocarbons containing 4 to 20 carbon atoms. Preferably $R=R^1$. In addition to the references given in the Background section, AKD technology is discussed by Gess and Lund, TAPPI J., p. 111 (January 1991) and Cates et al. "The Sizing of Paper", ed. by W. F. Reynolds, TAPPI Press, Atlanta (1989). Such materials are well known to comprise an equilibratable mixture of vinyl B-lactones and 2,4-substituted cyclobutane-1,3-diones.

Alkenyl succinic anhydride (or acid) (ASA) has the structure of

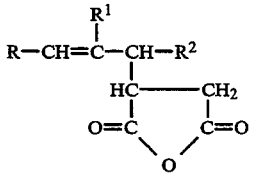

where R,$R^1$ and $R^2$ are independently H, $CH_3$ or $C_2$–$C_{18}$ alkyl, and $R+R^1+R^2$ have 5–30 carbon atoms. ASA is generally prepared by reaction of an iso-alkene with maleic anhydride. ASA sizing for paper is discussed by Hatanaka et al. *TAPPI J.,* p. 177, (February 1991) and by Farley and Wasser, "The Sizing of Paper", ed. by W. F. Reynolds, *TAPPI Press,* Atlanta (1989) in addition to G. G. Spence (cited above).

The additives are generally mixed together as aqueous suspensions and can be incorporated into the paper by addition either to the wet-end of the process, adding the suspensions to the paper pulp slurry, or by application of the additives to the paper sheet in the dry-end of the papermaking. The copolymer and sizing agent are mixed in a ratio ranging from about 1:10 to 10:1. The total amount of additives including both the polymer and the size is normally in the range of 0.05 to 4.0 wt % based upon the dry paper pulp.

Other advantages and features of our invention will be apparent to those skilled in the art from the following examples which are illustrative only and should not be construed to limit our invention unduly.

EXAMPLE 1

The polymerization of poly(vinyl acetate-co-N-vinylformamide) (VAc-NVF) was conducted by formation of a surfactant of NVF-co-VAc in the premix solution which stabilized the emulsion/suspension for the polymerization of the desired poly(vinyl acetate-co-N-vinylformamide).

The initial charge for the premix solution was 330 grams deionized water, 20 grams NVF (from Air Products and Chemicals), 15 grams VAc (from Hoechst-Celanese), and 1.0 grams tert-butyl peroxyneodecanoate (Triganox 23, from Noury Chemicals). The delay feed was 340 grams distilled VAc and 27 grams NVF.

The initial charge was loaded in a jacketed 5-liter resin kettle equipped with mechanical stirrer, condenser, nitrogen inlet, thermal couple and dropping funnel. Under stirring and blanketing with a weak flow of nitrogen, the mixture was heated via a circulating bath to 60° C., and the temperature was maintained for 30 minutes. The delay feed was added then within one hour through the dropping funnel. During the addition of delay feed, the solution became increasingly cloudy and heat of polymerization raised the temperature to 66–68, at which point the reflux started. The polymerization was continued for two more hours to yield a latex with 514 solids and a viscosity of 22,000 centipoises. The residual monomer as determined by bromate/bromide titration was 1.6 percent.

After filtration the wet cake of copolymer was suspended in 500 ml methanol. A solution of 45 ml of concentrated HCl (36–38%) in 100 ml methanol was added to the suspension which was heated to reflux for one hour. Drying in vacuum at 30° C. yielded about 180 grams of slightly yellow material in powder form, which readily dissolved in water. The product was an amine-functional poly(vinyl alcohol), PVOH/-VAm·HCl having about 12 mole % VAm·HCl.

EXAMPLES 2–20

Virgin Southern pine unbleached pulp was obtained from Herty (Canadian Freeness≈475). Handsheets were prepared and tested as follows:

Preparation of Laboratory Handsheets:

The protocol for preparation of laboratory handsheets was based on a procedure derived from TAPPI 205. Sufficient moist pulp to contain 24 g of pulp on a dry basis was soaked in about 1800 ml of tap water for at least three hours. The slurry was then transferred to a British Standard pulp disintegrator, any wet end additives (such as alum, anionic starch, and amine functional poly(vinyl alcohol)) to be utilized were added; the final volume was made up to 2000 ml, and the mixture was stirred for 50,000 revolutions. After mixing, the contents were transferred to a 10 liter plastic bucket and diluted to a final volume of 7.2 liters (approximately 0.33% consistency using a procedure subsequently described). The pH was adjusted to the desired value using 0.1M sulfuric acid or 0.1M sodium hydroxide. The slurry was stirred for 30 minutes at low speed using a laboratory mixer.

Twelve to sixteen 400 ml aliquots were dipped from the bucket and transferred to 600 ml beakers. Pulp slurries are difficult to pour while at the same time maintaining a uniform fiber concentration, so the following technique was used for obtaining aliquots with fairly uniform fiber concentrations. The pulp slurry was stirred with a large spatula, a 400 ml beaker was immersed below the surface and stirring was stopped. The beaker was withdrawn directly from the bucket, full to the brim, and the entire contents transferred to the 600 ml beaker. The British Standard handsheet machine was used to make handsheets from each beaker of slurry as described in TAPPI Method 205. After pressing as described, the sheets were conditioned overnight in a constant temperature/humidity chamber operated at 23° C. and 50% relative humidity (R.H.). The handsheets were removed from the mirror surface drying plates, allowed to equilibrate for 15–30 minutes at room temperature (R.T.), weighed and stored in polyethylene ziplock bags until testing.

Determination of Pulp Consistency:

The procedure utilized for the determination of pulp consistency was similar to TAPPI Method 240. Whatman #1 filter paper pads were oven dried for 15 minutes at 105° C., equilibrated for 5 minutes at R.T. and weighed to determine dry basis weight. About 2 grams of moist pulp was accurately weighed into a 600 ml beaker and slurried with 300 ml of water. The slurry was transferred to a small Waring Blendor and stirred for 30 seconds on low speed. The dispersed slurry was filtered using one of the pre-weighed filter papers and the moist pad was dried for 15 minutes at 105° C. on an Emerson speed dryer. The dried pad was equilibrated for 5 minutes at R.T. and weighed. The amount of dry pulp in the original sample was thus determined.

For each new container or pulp sample used for handsheet preparation, three samples were taken from various locations in the sample and the consistency was determined as described above. The average consistency so determined was used in all subsequent handsheet preparations using that material.

Testing of Laboratory Handsheets:

The basic evaluation method used in these Examples was the tensile breaking strength of paper strips as measured using an Instron machine (see TAPPI Method 495). Ten 0.5 inch wide strips were cut from the set of handsheets being evaluated using a paper strip cutter designed for this purpose. Five strips from each set were tested in dry mode to determine the tensile strength in units of lbs/in of width. The other five strips were soaked in tap water for 30 minutes, lightly blotted with a paper towel and then immediately tested using the same procedure, thus yielding the wet tensile strength. Independent tests showed 30 minutes soaking time was sufficient to completely saturate the paper. Some tests involved different water soak times as noted in the Examples.

Two sets of conditioning were employed: (a) room temperature for 7 days, and (b) room temperature for 7 days plus 1 hour at 100° C. Handsheets were prepared using no additives (Control Example 2) and with the polymer of Example 1, alkyl ketene dimer (AKD) or both, as shown in Table 1 which also gives wet and dry tensile index values determined as described above.

TABLE 1

| Example # | AKD wt % | PVOH/VAm.HCl wt % | Dry Tensile Index (a) | Dry Tensile Index (b) | Wet Tensile Index (a) | Wet Tensile Index (b) |
|---|---|---|---|---|---|---|
| 2 | 0 | 0 | 61.0 | 64.4 | 1.5 | 2.1 |
| 3 | 0 | 0.5 | 67.1 | 72.9 | 6.2 | 7.4 |
| 5 | 0.5 | 0 | 55.5 | 60.8 | 3.2 | 4.4 |
| 4 | 0.20 | 0.30 | 66.5 | 70.6 | 7.9 | 9.4 |
| 6 | 0.40 | 0.10 | 67.0 | 66.4 | 5.5 | 7.2 |
| 7 | 0.25 | 0.25 | 65.0 | 74.9 | 7.7 | 9.5 |
| 8 | 0.20 | 0.30 | 62.6 | 66.6 | 6.8 | 9.1 |
| 9 | 0.15 | 0.35 | 68.6 | 71.0 | 8.3 | 9.3 |
| 10 | 0.10 | 0.40 | 73.2 | 69.2 | 7.7 | 8.9 |

(a) Conditioned 7 days at room temperature
(b) Conditioned 7 days at room temperature plus 1 hour at 100° C.

The results noted in Table 1 are illustrated in the FIGURE showing the synergistic behavior graphically. These results show wet strength values for paper containing both the AKD and the PVOH/VAm·HCl that are significantly higher than their additive effects which would be expected from the use of either material alone. In the FIGURE, plots (a) and (a') represent the actual and expected values (respectively) for the wet tensile index of samples conditioned at room temperature for 7 days. Plots (b) and (b') show the actual and expected values, respectively, for the wet tensile index of samples conditioned at room temperature for 7 days and at 100° C. for 1 hour.

The properties (wet and dry) of samples from these handsheets are listed in Table 2.

TABLE 2

| Test Conditioning | Example 2 (a) R.T. | Example 2 (b) 1 hr@100° C. | Example 3 (a) R.T. | Example 3 (b) 1 hr@100° C. | Example 4 (a) R.T. | Example 4 (b) 1 hr@100° C. | Example 5 (a) R.T. | Example 5 (b) 1 hr@100° C. |
|---|---|---|---|---|---|---|---|---|
| Grammage, g/m$^2$ | 155.6 | 155.6 | 153.2 | 153.2 | 158.2 | 158.2 | 155.0 | 155.0 |
| Basis Wt lb/ft$^2$ | 31.9 | 31.9 | 31.4 | 31.4 | 32.4 | 32.4 | 31.7 | 31.7 |
| Dry Tensile, lb/in | 54.2 | 57.2 | 58.7 | 63.8 | 60.1 | 63.8 | 49.1 | 53.8 |
| Dry Tensile, kN/m | 9.5 | 10.0 | 10.3 | 11.2 | 10.5 | 11.2 | 8.6 | 9.4 |
| Wet Tensile, lb/in | 1.3 | 1.9 | 5.4 | 6.5 | 7.1 | 8.5 | 2.8 | 3.9 |
| Wet Tensile, kN/m | 0.2 | 0.3 | 0.9 | 1.1 | 1.2 | 1.5 | 0.5 | 0.7 |
| Dry Tensile Index, Nm/g | 61.0 | 64.4 | 67.1 | 72.9 | 66.5 | 70.6 | 55.5 | 60.8 |
| Wet Tensile Index, Nm/g | 1.5 | 2.1 | 6.2 | 7.4 | 7.9 | 9.4 | 3.2 | 4.4 |
| Wet/Dry (%) | 2.4% | 3.3% | 9.2% | 10.2% | 11.8% | 13.3% | 5.7% | 7.2% |
| Breaking Length | 6101 | 6437 | 6708 | 7291 | 6654 | 7064 | 5546 | 6077 |

The PVOH/VAm·HCl was dissolved in water and added to the pulp slurry in the pulp disintegrator prior to handsheet preparation. The AKD used was Hercon 70 (Hercules). It is a water based system believed to also contain some cationic starch for stabilizing the water dispersion (emulsion). When used together, the PVOH/VAm·HCl and AKD were predissolved in water prior to addition to the pulp slurry in the pulp disintegrator. The AKD was available as an emulsion and the dry weight was determined to establish the percent used. When used alone, the AKD was diluted in water prior to addition to the pulp slurry in the pulp disintegrator.

EXAMPLE 11

Samples of Examples 2, 3, 5 and 7 were tested using the standard Mullen Burst test. Tests were run dry and wet. The dry test involved 5 samples each, dried and conditioned at 504 R.H. and room temperature prior to testing. In the wet burst test, two conditions were employed. An instantaneous wetting time (immersion for approximately 2 seconds) and a 5-minute immersion in water were the chosen conditions followed by blotting on adsorbent paper to remove excess water. The burst tests were then immediately run. The data are listed in Table 3. The combination of AKD and PVOH/VAm·HCl yields better wet burst strength than AKD or PVOH/VAm·HCl alone at the same total additive level.

TABLE 3

| Example | AKD wt % | PVOH/VAm.HCl wt % | Mullen Burst Strength (psi) Dry | Wet Instantaneous | Wet (5 min. immersion) |
|---|---|---|---|---|---|
| 2 | 0 | 0 | 104 | 3 | — |
| 3 | 0 | 0.5 | 127 | 17 | 18 |
| 5 | 0.5 | 0 | 101 | 72 | 11 |
| 7 | 0.25 | 0.25 | 102 | 90 | 26 |

EXAMPLES 12–19

A sample of wet pulp (Canadian Freeness≈700) (unbleached) was obtained from James River. Handsheets were prepared and tested according to the procedure used in Examples 2–10, except for the polymer and size additives which are given in Table 4 as weight percent based on dry pulp weight. The polymer was PVOH/VAm·HCl of Example 1 and the sizing agents were alkenyl succinic anhydrides (ASA), namely, dodecenyl succinic anhydride (DDSA), octenyl succinic anhydride (OSA), or n-octadecenyl succinic anhydride (n-ODSA). The DDSA and n-ODSA were obtained from Humphrey Chemical Company, and the OSA was obtained from Milliken Chemical Company. Table 4 also lists the wet and dry tensile index values.

TABLE 4

| Example | 12 | 13 | 14 | 15 | 16 | 17 | 18 | 19 |
|---|---|---|---|---|---|---|---|---|
| PVOH/VAm.HCl (wt %) | 0 | 0.5 | 0.25 | 0 | 0.25 | 0 | 0.25 | 0 |
| DDSA (wt %) | — | — | 0.25 | 0.5 | — | — | — | — |
| OSA (wt %) | — | — | — | — | 0.25 | 0.5 | — | — |
| n-ODSA (wt %) | — | — | — | — | — | — | 0.25 | 0.5 |
| Dry Tensile Index (Nm/g)[a] | 43 | 65.4 | 62.3 | 42.9 | 59.1 | 41.3 | 65.6 | 46.8 |
| Dry Tensile Index (Nm/g)[b] | 46 | 76.1 | 57.9 | 45.4 | 65.0 | 41.8 | 61.9 | 49.3 |
| Wet Tensile Index (Nm/g)[a] | 1.1 | 8.2 | 4.7 | 1.1 | 4.7 | 1.0 | 6.0 | 1.1 |
| Wet Tensile Index (Nm/g)[b] | 1.5 | 8.3 | 5.6 | 1.5 | 5.8 | 1.4 | 6.4 | 2.7 |

[a]Conditioned 7 days at room temperature.
[b]Conditioned 7 days at room temperature and 1 hour at 100° C.

The comparison of wet tensile index and dry tensile index for the ASA-PVOH/VAm·HCl mixtures versus the expected result assuming additivity is given in Table 5. The additive expectation was calculated from the average of the ASA and the PVOH/VAm·HCl unblended control samples. In all cases, the wet tensile index was equal to or higher than the additive calculation, thus exhibiting synergistic behavior as also noted with AKD-PVOH/VAm·HCl blends, although not as pronounced. In most cases, the dry tensile index generally exhibited higher values for the mixture as compared to the additive calculation.

TABLE 5

| | Wet Tensile Index (Nm/g) | | Dry Tensile Index (Nm/g) | |
|---|---|---|---|---|
| | (a) | (b) | (a) | (b) |
| Example 14 DDSA + PVOH/VAm.HCl | 4.7 | 5.6 | 62.3 | 57.9 |
| Additive Expectation | 4.65 | 4.9 | 54.2 | 60.8 |
| Example 16 OSA + PVOH/VAm.HCl | 4.7 | 5.8 | 59.1 | 65.0 |
| Additive Expectation | 4.6 | 4.85 | 53.4 | 59.0 |
| Example 18 n-ODSA + PVOH/VAm.HCl | 6.0 | 6.4 | 65.6 | 61.9 |
| Additive Expectation | 4.65 | 5.5 | 56.1 | 62.7 |

(a) Conditioned 7 days at room temperature.
(b) Conditioned 7 days at room temperature and 1 hour at 100° C.

EXAMPLES 21–24

Using the procedure described in the foregoing Examples, handsheets were prepared from bleached kraft pulp obtained from The State University of New York using as additives the PVOH/VAm·HCl polymer of Example 1 and AKD. Wet and dry tensile tests were run on conditioned samples and the results are shown in Table 6.

Table 6

TABLE 6

| Example # | AKD wt % | PVOH/VAm.HCl wt % | Dry Tensile (Nm/g) (a) | Dry Tensile (Nm/g) (b) | Wet Tensile (Nm/g) (a) | Wet Tensile (Nm/g) (b) |
|---|---|---|---|---|---|---|
| 21 | 0 | 0 | 0.80 | 0.80 | 33.7 | 33.2 |
| 22 | 0.5 | 0 | 2.2 | 2.6 | 30.3 | 31.2 |
| 23 | 0 | 0.5 | 1.22 | 1.22 | 33.6 | 34.6 |
| 24 | 0.25 | 0.25 | 3.8 | 3.8 | 33.4 | 35.0 |

(a) Conditioned 7 days at room temperature
(b) Conditioned 7 days at room temperature plus 1 hour at 100° C.

Although the bleached pulp paper demonstrated little or no improvement in dry tensile from the additive combination, there was clearly a synergistic behavior between the AKD and the PVOH/VAm·HCl in wet tensile enhancement. The polymer alone gave marginal wet tensile improvement to the bleached pulp, in contrast to the more significant increases observed for unbleached pulp, as shown by Examples 2 and 3. Yet, when combined with AKD, the results for unbleached pulp were markedly better than what could have been expected from the additive effects of AKD and polymer alone in this product.

EXAMPLES 25–30

(Comparative)

Evaluations of wet and dry tensile properties were made on several unbleached pulp (James River Pine) handsheets made with AKD-cationic starch blends as are commonly used in the paper industry. Preparation, conditioning and testing procedures were as noted for the prior Examples. Results are given in Table 7.

TABLE 7

| Example # | AKD wt % | Cationic Starch Type | Cationic Starch (wt %) | Wet Tensile Index (Nm/g) (a) | Wet Tensile Index (Nm/g) (b) | Dry Tensile Index (Nm/g) (a) | Dry Tensile Index (Nm/g) (b) |
|---|---|---|---|---|---|---|---|
| 25 | 0 | — | 0 | 1.1 | 1.1 | 43.0 | 46.0 |
| 26 | 0.5 | — | 0 | 1.9 | 2.6 | 42.4 | 47.0 |
| 27 | — | Apollo 600 | 0.5 | 1.2 | 1.6 | 46.5 | 43.5 |
| 28 | 0.25 | Apollo 600 | 0.25 | 1.1 | 1.8 | 46.3 | 47.4 |
| 29 | — | Astro X-101 | 0.5 | 1.0 | 1.7 | 42.6 | 45.5 |
| 30 | 0.25 | Astro X-101 | 0.25 | 1.3 | 2.0 | 42.7 | 45.2 |

Conditioning: (a) 7 days at R.T., (b) 7 days at R.T. and 1 hour at 100° C.

The data of Table 7 show that there is no synergy between AKD and cationic starch with respect to tensile enhancement. Use of AKD alone at 0.5 wt. percent did appear to improve wet tensile over the control (Example 25) and use of intermediate levels of AKD (0.25 wt. percent) provided values which were proportionate or below. No consistent trend was noted for dry tensile values.

EXAMPLES 31–32

(Comparative)

Poly(vinyl alcohol), PVOH, was used with AKD instead of cationic starch as shown in Examples 27–30. The PVOH was Vinol 205 from Air Products and Chemicals, Inc.

| Example # | AKD wt % | PVOH wt % | Wet Tensile Index (a) | Wet Tensile Index (b) | Dry Tensile Index (a) | Dry Tensile Index (b) |
|---|---|---|---|---|---|---|
| 25 | 0 | 0 | 1.1 | 1.5 | 43.0 | 46.0 |
| 26 | 0.5 | 0 | 1.9 | 2.6 | 42.4 | 47.0 |
| 31 | 0 | 0.5 | 1.0 | 1.3 | 41.6 | 45.6 |
| 32 | 0.25 | 0.25 | 1.0 | 1.5 | 43.5 | 42.8 |

(a) Conditions 7 days at room temperature
(6) Conditions 7 days at room temperature plus 1 hour at 100° C.

PVOH demonstrated no tensile improvements alone or with AKD.

EXAMPLE 33

Water sorption tests were run on handsheets made from James River Pine Pulp and from Herty unbleached Pulp modified with AKD and PVOH/VAm·HCl alone and together in various proportions with total add-on at 0.5 wt. percent. Results with the polymer alone showed water sorption to be only slightly lower than the control with saturation observed almost immediately upon immersion. AKD modification showed much lower sorption which increased with time. This reduced water sorption effect was also noted for the AKD-PVOH/VAm·HCl blend with most of the reduced sorption benefit achieved at 0.1 wt. percent AKD (0.4 wt. % polymer) and essentially full benefit at the 0.2, 0.3 and 0.4 weight percent AKD levels (0.3, 0.2 and 0.1 wt. percent polymer, correspondingly). From this study it appears that AKD when used with PVOH/VAm·HCl continues to serve as a sizing agent in addition to enhancing synergistically, in cooperation with the polymer, the wet tensile strength of the paper.

EXAMPLE 34

Additional primary amine containing poly(vinyl alcohols) are useful in this invention. The reaction of poly (vinyl alcohol) with 4-aminobutyraldehyde dimethyl acetal (ABAA) $H_2N—CH_2—CH_2—CH_2—CH(OMe)_2$ allows for a another facile route for primary amine incorporation. A sample of Airvol 325LA poly(vinyl alcohol) was reacted with 10 mole % ABAA in a water solution (see synthesis Example 35). The resultant product was evaluated as per the established testing protocol noted for the other examples. Using the James River pulp (Canadian Freeness ≈700), the wet and dry tensile index values are shown for the addition of 0.5% PVOH-/ABAA, 0.5% AKD, 0.25% PVOH/ABAA/0.25% AKD. The results demonstrate the blend yields higher values than additive expectations.

TABLE 8

| Sample Description | 1 Week @ RT | | 1 week @ RT + 1 hour @ 100° C. | |
|---|---|---|---|---|
| | Dry Tensile Index Nm/g | Wet Tensile Index Nm/g | Dry Tensile Index Nm/g | Wet Tensile Index Nm/g |
| Control | 46.5 | 1.1 | 51.0 | 2.4 |
| +0.5% AKD (Hercon 70) | 48.2 | 1.6 | 46.2 | 2.8 |
| +0.5% PVOH/ABAA | 83.0 | 7.7 | 68.9 | 9.3 |
| +0.25% PVOH/ABAA 0.25% AKD | 54.9 | 6.4 | 65.1 | 7.3 |
| Additive Expectation for Wet Tensile Index | — | 4.65 | — | 6.05 |

SYNTHESIS EXAMPLE 35

Poly(vinyl alcohol) (Airvol 325LA, 20.00 g, 0.454 mole) was dissolved in water (100 mL) at 80° C. under nitrogen. After dissolution, concentrated hydrochloric acid (6.53 g, 0.0681 mole) and 4-aminobutyraldehyde dimethyl acetal (6.05 g, 0.0454 mole) were added to the reaction along with additional water (30 mL). The reaction was then continued at 80° C. under nitrogen for 4.5 h. The reaction was not neutralized. The water was removed on a rotary evaporator, and the product was dried further in a vacuum oven (50° C./1 torr) to give 27.68 g of product.

EXAMPLE 36

Runs were made to show the effects of the addition of AKD and PVOH/VAm to paper at various add-on levels (% dry-on-dry). The experimental procedure was as described in the previous examples. The AKD employed was Hercon 70 and the paper pulp utilized was an unbleached southern pine kraft with a Canadian Freeness of ≈700. The poly(vinyl alcohol/vinylamine) employed was prepared as follows:

A copolymer of N-vinylformamide and vinyl acetate was produced in a continuous polymerization process using two reactors in series. The reactors were refluxed at a pressure of 1–2 psig. The first reactor had a feed of 31.7 g/min vinyl acetate and 1.2 g/min N-vinylformamide in one stream and 4.2 g/min methanol and 0.0084 g/min tert-butylperoxyneodecanoate initiator in the other stream. The second reactor had a feed of 3.3 g/min vinyl acetate, 0.3 g/min N-vinylformamide and 0.8 g/min methanol. Unreacted vinyl acetate was removed from the copolymer solution which discharged from the reactors. The copolymer solution remaining was then continuously reacted with a solution of 804 methanol, 104 sodium hydroxide and 104 water (by weight) to remove the acetate gruops. The copolymer solution was fed at 176 g/min at a target temperature of about 38° F. The methanol, sodium hydroxide and water solution was fed at 27.6 cc/min. The resulting vinyl alcohol/N-vinylformamide solid was ground, washed with methanol and dried. The dried copolymer was then slurried in methanol. The slurry contained 10 wt % of the copolymer. Concentrated (38 wt %) hydrochloric acid was then added slowly to the slurry at a ratio of 0.20 g of acid per 1.00 g of copolymer. The resulting slurry was then heated to 60° C. for 3 h, cooled to room temperature, filtered, washed with methanol and dried to yield a vinyl alcohol/vinylamine. hydrochloride/N-vinylformamide (92/7/1 mole %) terpolymer. This polymer was evaluated as shown in Table 9 in a series of handsheets.

The handsheets were conditioned at 100° C. for 1 hour followed by one week at 504 R.H. and room temperature before testing. Wet tensile properties were obtained after 5 sec., after 30 sec., and after 30 min. soak. Retention of strength after longer immersion times indicates true wet strength as opposed to a temporary sizing effect. The addition levels employed and dry and wet tensile index values are listed in Table 9. The results at 5 sec. immersion do not clearly show advantages for AKD/PVOH-VAm combinations. After 30 sec. and 30 min. immersion times, the AKD-PVOH/-VAm combinations definitely show the advantage of the mixture versus the unblended examples and show this advantage at different add-on levels. The 2/1 PVOH-VAm/AKD (0.4/0.2) ratio shows the most synergy. Note that sizing agents generally show short term (temporary) wet strength. Effective wet strength additives offer retention of wet strength at longer immersion times. The PVOH/VAm/AKD combination offers true wet strength as judged by the 30 minute immersion data. The short term data (5 sec. immersion) indicates AKD, PVOH-VAm, and combinations thereof offer sizing effects.

TABLE 9

| Sample Description | | | Wet Tensile (Nm/g) | | |
|---|---|---|---|---|---|
| Wt. % AKD | Wt. % PVOH/VAm | Dry Tensile Index Nm/g | 5 sec. Immersion | 30 sec. Immersion | 30 min. Immersion |
| 0 | 0 | 41.8 | 9.0 | 4.7 | 2.8 |
| 0.1 | 0 | 41.6 | 19.9 | 11.4 | 3.0 |
| 0.2 | 0 | 39.1 | 18.7 | 12.7 | 3.8 |

TABLE 9-continued

| Sample Description | | | Wet Tensile (Nm/g) | | |
|---|---|---|---|---|---|
| Wt. % AKD | Wt. % PVOH/VAm | Dry Tensile Index Nm/g | 5 sec. Immersion | 30 sec. Immersion | 30 min. Immersion |
| 0.3 | 0 | 43.0 | 24.4 | 11.3 | 4.1 |
| 0.6 | 0 | 39.2 | 23.4 | 13.9 | 3.7 |
| 0 | 0.1 | 44.0 | 16.1 | 6.6 | 3.7 |
| 0 | 0.2 | 47.7 | 27.6 | 10.4 | 5.6 |
| 0 | 0.3 | 48.4 | 23.9 | 13.1 | 6.9 |
| 0 | 0.6 | 55.5 | 23.5 | 11.8 | 7.4 |
| 0.1 | 0.1 | 43.0 | 25.3 | 14.1 | 6.0 |
| 0.2 | 0.2 | 44.5 | 24.4 | 20.3 | 7.0 |
| 0.3 | 0.3 | 46.7 | 29.2 | 19.3 | 7.6 |
| 0.2 | 0.4 | 53.5 | 34.6 | 22.5 | 10.4 |

EXAMPLE 37

U.S. Pat. No. 4,784,727 teaches the use of specific polymers as fixing and sizing accelerating agents. The patent does not note utility of these agents as wet strength additives. In order to determine if these polymers and combinations with a cellulosic reactive size offer utility as wet strength additives, a sample was prepared as per the noted patent (agent D in the '727 patent). The procedure employed was:

Isopropanol (50.009) was heated to 80° C. and flushed with nitrogen. A mixture of N,N-dimethylaminoethyl methacrylate (28.009), styrene (89.009) and acrylonitrile (23.009) were added to the hot isopropanol over a 2 h period while maintaining a nitrogen atmosphere. In a separate feed stream, a solution of azoisobutyronitrile (5.0009) in acetone (22.009) was added to the reaction concurrently with the monomer feed over 2 h. After completing addition of the delay feeds, the polymerization was maintained at 80° C. for 2 h. The polymerization was then reactivated by addition of a solution of azoisobutyronitrile (0.5009) in acetone (3.009) and it was maintained at 80° C. for an additional 12 h. After completing the polymerization, acetic acid (20.00 g) and water (600.00 g) were added to the product mixture and 120 mL of liquid was removed by vacuum distillation. This yielded a 20.2 wt % aqueous solution of polymer testing.

Test handsheets were prepared using an unbleached southern pine kraft pulp with a Canadian Freeness of ≈700. The AKD employed was Hercon 70. The handsheet preparation and testing followed the protocol noted in the above examples. Also samples were prepared using a bleached pulp source similar to that employed in the patent application. The dry tensile index and wet tensile index results are noted in Table 10.

TABLE 10

| Sample Description | Pulp | Dry Tensile Index Nm/g | Wet Tensile Index Nm/g |
|---|---|---|---|
| Control | Unbleached | 41.8 | 2.8 |
| 0.3 wt. % AKD | Unbleached | 43.0 | 4.1 |
| 0.5 wt. % AKD | Unbleached | 43.6 | 3.7 |
| 0.2 wt. % AKD + 0.3 wt. %** | Unbleached | 39.3 | 4.9 |
| 0.5 wt. %** | Unbleached | 39.9 | 3.5 |
| Control | Bleached | — | 0.6 |
| 0.5 wt. % AKD | Bleached | 35.2 | 2.2 |
| 0.2 wt. % AKD + 0.3 wt. %** | Bleached | 31.8 | 2.2 |
| 0.5 wt. % ** | Bleached | 35.1 | 1.4 |
| 0.2 wt. % AKD + 0.3 wt. % PVOH/VAm* | Bleached | — | 4.9 |
| 0.5 wt. % | Bleached | — | 1.4 |

TABLE 10-continued

| Sample Description | Pulp | Dry Tensile Index Nm/g | Wet Tensile Index Nm/g |
|---|---|---|---|
| PVOH/VAm* | | | |

*PVOH/VAm (8 mole % VAm)
**Polymer of Example 37

The data in Table 10 shows that the polymer example from U.S. Pat. No. 4,784,727 is not an effective wet strength additive as is or in combination with AKD. PVOH/VAm offers much better wet strength particularly if AKD is added for both unbleached and bleached pulp. Note that PVOH/VAm is less effective for bleached pulp than unbleached pulp, however, the AKD/PVOH/VAm combination is effective for both.

Other advantages and features of our invention will be apparent to those skilled in the art from the foregoing disclosure without departing from the spirit or scope of the invention.

We claim:

1. A method of improving the wet-strength of cellulosic paper which comprises adding to the paper during the papermaking process an amine-functional poly(vinyl alcohol) copolymer having from 1 to 25 mole % amine functionality based upon incorporated monomer and a reactive sizing agent, which sizing agent comprises an alkyl ketene dimer or alkenyl succinic anhydride which have pendant substituents which contain a combined total of at least 8 carbon atoms, wherein said copolymer and reactive sizing agent are added to the paper in a combined concentration of from about 0.05 to 4 wt % based upon the dry paper pulp, and the weight ratio of the copolymer to the sizing agent is from 1:10 to 10:1.

2. The method of claim 1 wherein said copolymer and reactive sizing agent are added to the paper pulp slurry.

3. The method of claim 1 wherein said copolymer and reactive sizing agent are added to the paper sheet.

4. The method of claim 1 wherein said amine functional poly(vinyl alcohol) is a poly(vinyl alcohol/vinylamine) wet-strength copolymer.

5. The method of claim 1 wherein said reactive sizing agent is an alkyl ketene dimer comprising the structural formula:

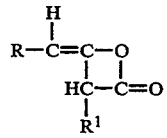

wherein R and $R^1$ are independently straight or branched chain hydrocarbons containing 4 to 20 carbon atoms.

6. The method of claim 1 wherein said reactive sizing agent is an alkenyl succinic anhydride comprising the structural formula:

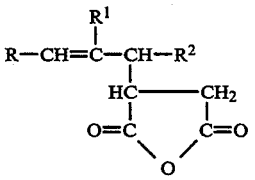

wherein each R, $R^1$ and $R^2$ are independently H, $CH_3$ or $C_2$–$C_{18}$ alkyl and $R+R^1+R^2$ have 5–30 carbon atoms.

7. The method of claim 4 wherein said copolymer is a hydrolyzed copolymer of vinylacetate and 1 to 25 mole percent, based upon incorporated monomer, of N-vinylformamide.

8. The method of claim 7 wherein said copolymer before hydrolysis contains 5 to 20 mole percent of incorporated N-vinylformamide.

9. A cellulosic paper product having improved wet-strength containing products formed by addition to the paper during manufacture of from about 0.05 to 4 wt %, based upon dry paper pulp, of the combination of an amine-functional poly(vinyl alcohol) copolymer having from 1 to 25 mole % amine functionality based upon incorporated monomer and a cellulose reactive size which is a 4 or 5 membered cyclic ester or anhydride having one or more alkyl or alkenyl substituents which substituents contain a combined total of at least 8 carbon atoms , which copolymer and reactive size are added in a weight ratio from 1:10 to 10:1.

10. The product of claim 9 wherein said resin is a hydrolyzed copolymer of vinyl acetate and 1 to 25 mole percent, based upon incorporated monomer, of N-vinylformamide and said size is alkyl ketene dimer or alkenyl succinic arthydride.

11. The method of claim 9 wherein the amine-functional poly(vinyl alcohol) is the reaction product of 4-aminobutyraldehyde and a poly(vinyl alcohol) homo- or copolymer.

* * * * *